United States Patent [19]

Bhagat et al.

[11] 4,222,838

[45] Sep. 16, 1980

[54] METHOD FOR CONTROLLING PLASMA ETCHING RATES

[75] Inventors: Jayant K. Bhagat, Troy; Martin C. Steele, Bloomfield Hills, both of Mich.

[73] Assignee: General Motors Corporation, Detroit, Mich.

[21] Appl. No.: 915,149

[22] Filed: Jun. 13, 1978

[51] Int. Cl.[2] ..... C23F 1/00

[52] U.S. Cl. ..... 204/192 E; 204/298; 156/643

[58] Field of Search ..... 204/164, 192 E, 192 EC, 204/298; 156/643, 345

[56] References Cited

U.S. PATENT DOCUMENTS

| | | | |
|---|---|---|---|
| 3,544,445 | 12/1970 | Moseson | 204/298 |
| 3,940,506 | 2/1976 | Heinecke | 204/192 E |
| 3,971,684 | 7/1976 | Muto | 156/643 |
| 4,057,460 | 11/1977 | Saxena | 204/192 E |
| 4,134,817 | 1/1979 | Bourdon | 204/192 E |

OTHER PUBLICATIONS

S. Matsuo and Y. Takehara, Preferential $SiO_2$ Etching on Si Substrate . . . , *Japan J. Appl. Phys.*, vol. 16, (1977), No. 1, pp. 175–176.

John Hollahan et al., Plasma-Enhanced Chemical Vapor Deposition of Thin Films . . . , Applied Materials, Inc., Santa Clara, Calif. 95051.

P. D. Davidse, Theory and Practice of RF Sputtering, *Vacuum*, vol. 17, No. 3, pp. 139–145.

IBM Tech Disc Bulletin, vol. 10, No. 4, Sep. 1967, Cuomo et al., Substrate Cleaning by Low-Energy Bombardment.

IBM Tech Disc Bulletin, vol. 20, No. 1, Jun. 1977, Coburn, Enhancing the Fragmentation of Molecular Species in a Plasma Etching Discharge.

Bersin, A Survey of Plasma-Etching Processes, Solid State Technology, vol. 19, No. 5, pp. 31–36, May 1976.

IBM Tech Disc Bulletin, vol. 8, No. 8, Jan. 1966, Davidse, Masking Technique for Cathodic Sputter Etching.

*Primary Examiner*—John H. Mack
*Assistant Examiner*—William Leader
*Attorney, Agent, or Firm*—Douglas D. Fekete

[57] ABSTRACT

In a preferred embodiment, the etch rate of a silicon-containing surface subjected to a RF discharge plasma containing reactive etching species is selectively affected by electrically insulating the surface from the plasma-generating RF power source and by applying to the surface a predetermined time-constant electrical potential. The applied potential apparently interacts with the plasma constituents in the immediate vicinity of the surface to alter the concentration of reactive species and thereby change the rate of attack of the plasma upon the surface. The applied potential, depending upon its polarity and strength, is useful to selectively increase or decrease the etch rate of the desired surface exposed to a predetermined plasma without significantly interfering with the overall RF plasma discharge.

5 Claims, 1 Drawing Figure

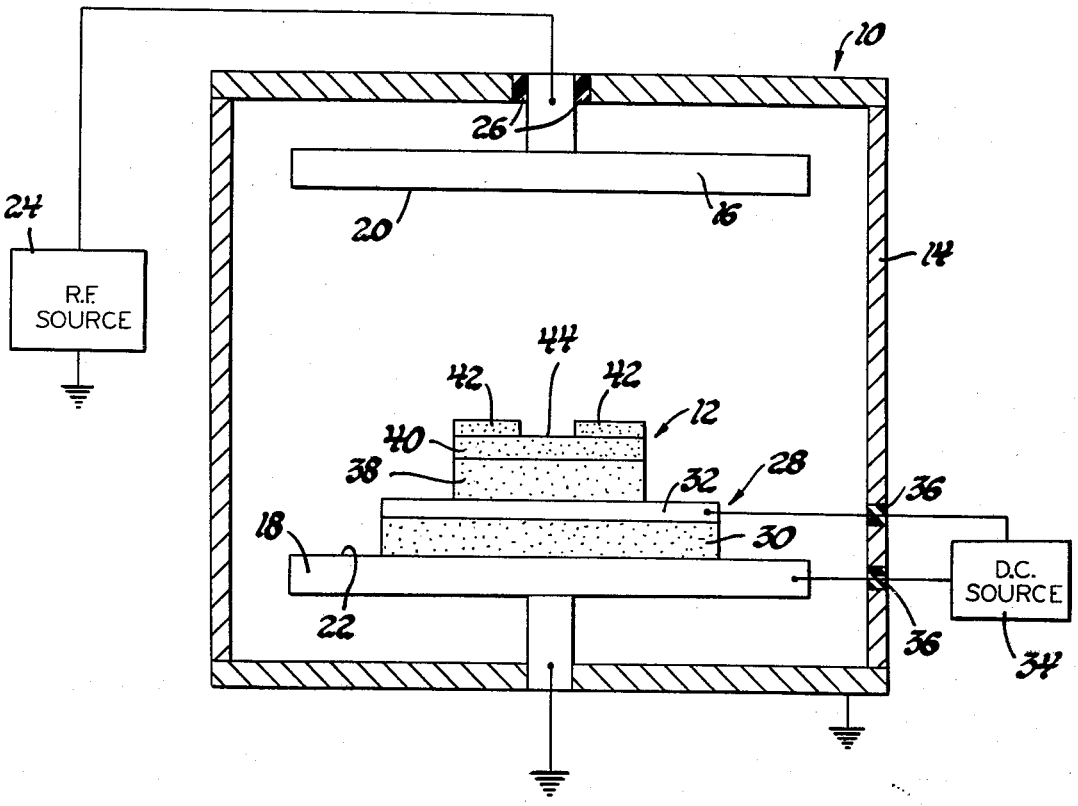
10
26
24
R.F.
SOURCE
20
16
14
44
42
42
12
40
38
32
28
36
18
30
D.C.
SOURCE
22
36
34

METHOD FOR CONTROLLING PLASMA ETCHING RATES

BACKGROUND OF THE INVENTION

This invention relates to a method of etching a surface by exposing it to a RF discharge plasma containing a chemical species that reacts with the surface to form a gaseous product. The plasma etching method of this invention is particularly useful in the manufacture of integrated circuit chips and related semiconductor devices.

Semiconductor chips are typically manufactured by subjecting a silicon wafer to a predetermined sequence of surface treatment operations to form the desired electrically operative features. At some stages, it is desired to remove material from selected areas of the wafer surface. One removal process calls for exposing the wafer surface to a RF discharge plasma containing reactive etching species. The plasma is generated by applying a radio frequency (RF) signal to a low pressure gas. A plasma generated in a suitable gas, such as carbon tetrafluoride, creates chemical species that collide with the wafer surface and react with the exposed material. The reaction forms gaseous products, most notably silicon fluoride, that diffuse into the atmosphere. While the reaction mechanism is not well understood, it is believed that fluorine atoms and other fluorine-containing radicals play a predominate role. This is in contrast to sputter etching wherein a plasma discharged in an inert gas such as argon produces excited ions that violently impact the surface and physically knock material away.

It is known that a RF discharge plasma in carbon tetrafluoride gas etches silicon and also silicon compounds typically used as semiconductor overlayers, such as silicon dioxide $SiO_2$, silicon nitride $Si_3N_4$ and polysilicon. A given plasma etches these materials at different rates. Typically, $$E_{Si_3N_4} > E_{Si} > E_{SiO_2}$$

where $E_x$ represents the etch rate of material X.

Whatever material is being etched, faster etch rates are generally desired to reduce processing time and power. Adjusting the discharge to increase the etch rate of a particular material is frequently not satisfactory. In some instances, it may be desired to decrease the etching of a particular material by a predetermined plasma. Therefore, it is an object of this invention to provide a method capable of selectively increasing or decreasing the etch rate of a desired material exposed to a RF plasma without perceptibly altering the discharge power, the gas pressure or other plasma parameters.

It has also been heretofore difficult to simultaneously etch two wafers exposing different materials having different etch rates. For a given processing time, one wafer was overetched or the other was not completely etched. Likewise it has been a problem to etch different materials on the same wafer. For example, when opening a window in the $SiO_2$ film on a silicon base, it is desired to minimize the attack upon the silicon. But the etch rate for silicon is typically much higher than for silicon dioxide and so the plasma roughens or pits the freshly exposed silicon. In short, better control over the relative etch rates of different materials exposed to a predetermined RF discharge plasma would provide additional processing flexibility and would permit higher quality semiconductor devices and circuits to be produced.

Therefore, it is an object of this invention to provide a method for better controlling the etch rates of two or more materials exposed to a predetermined RF discharge plasma containing reactive etching species. This is accomplished without necessarily changing the RF signal or the nature of the gas. The improved etch control of this invention can be exerted in a selected region of the plasma or during selected processing times without interrupting or affecting the overall plasma discharge. It is a more specific object of this invention to provide such a method for selectively adjusting the relative etch rates of two or more silicon-containing materials subjected to a single predetermined RF discharge plasma containing reactive etching species, which method is selectively exercisable independent of the plasma parameters to produce an improved etch pattern for semiconductor wafer manufacture.

Another problem encountered in plasma etching semiconductor wafers is that the etch rates are generally not uniform. For example, etch rates are usually faster about the circumference of the wafer than near the center. Also when processing a plurality of silicon wafers concurrently, it has been found that etch rates may vary from wafer to wafer depending upon their position in the plasma apparatus. It is therefore a further object of this invention to provide a method for improving the uniformity of etch rates of a desired material subjected to a predetermined RF discharge plasma containing a reactive etching species across a wafer surface and among the surfaces of a plurality of wafers.

SUMMARY OF THE INVENTION

Broadly speaking, these and other objects are accomplished by subjecting the surface to be etched to a RF discharge plasma containing chemically reactive etching species and maintaining a time-constant electrical potential in the region of the plasma near the surface being etched. The source of the time-constant potential is independent of the RF power source and has a minimal effect upon the plasma discharge. The time-constant potential is suitably obtained by placing an electrical conductor near the surface being etched and connecting it to a DC power supply. When electrically biased with a DC potential, the conductor interacts with plasma constituents in the immediate region and affects their ability to react with and etch the surface material. Depending upon the polarity and magnitude of the applied potential, the etch rate for a particular material is either increased or decreased. In a preferred embodiment, a silicon wafer to be etched is itself connected to the DC power supply and thus carries the plasma-interacting potential.

While this invention is not limited to any particular theory, it is believed that applying the time-constant potential in the RF plasma alters the composition of the plasma in the immediate region. A RF discharge in a suitable gas creates a plurality of excited ionic and free radical species, some of which react with nearby solid material. The reaction rates depend upon the nature and concentration of the reactive species. It is believed that the applied electrical charge interacts with nearby species by transferring valence electrons to or from the species. That is, a positive species interacts with a negative electrical charge to form a free radical. The cumulative effect of the electron-transferring interactions with the various plasma constituents is a substantial change in the plasma composition in the immediate area of the applied potential. The change in composition produces a change in the plasma reactivity. While the plasma kinetics are not completely understood, the effect of the applied potential upon the etch rate has been clearly demonstrated.

In a preferred embodiment, a silicon wafer is subjected to a RF discharge plasma created between two opposed, horizontally oriented electrode plates in a low pressure, carbon tetrafluoride atmosphere. The wafer is positioned upon an insulating support that in turn rests upon the lower electrode. The support is formed of any suitable material to electrically insulate the wafer from the lower RF electrode. Alumina or a fluorocarbon polymer is preferred, the latter having a surprising effect when used in a carbon tetrafluoride plasma. The surface of the support on which the wafer lies is provided with a conductive metal coating, preferably of aluminum. The coating is connected to a DC power source that applies an electrical potential to the coating and thereby electrically biases the wafer. Thus, the support insulates the wafer from contact with the RF power source and electrically biases the wafer.

The applied potential in the plasma creates a space charge on the wafer surface that interacts with nearby plasma constituents. The precise effect upon the plasma etch rate depends upon several factors including the surface composition, the gas composition, the support composition and the plasma power. For silicon and silicon-containing materials in a fluorine-containing plasma, it is generally found that a negative bias increases etching and a positive bias reduces etching. Important exceptions have been observed, most particularly involving fluorocarbon polymer supports. The extent of effect upon the etch is related to the voltage applied. It has been found that an applied potential of 140 volts or less has a substantial effect upon the etch rates without interfering with the overall RF discharge. Thus, a relatively small potential compared to the power required for the RF plasma can be utilized to effect the plasma etch rates.

The method of this invention enables the etch rate of a surface subjected to a RF discharge plasma containing chemically reactive species to be selectively increased or decreased, thus providing additional control over the etching operation. The applied potential affects the plasma only in the immediate region, thereby enabling the etch rate on several surfaces to be independently controlled. Since the etch rate effect depends in part upon the nature of the exposed material, the applied potential may be selected to provide an improved etch pattern for wafers having more than one exposed material. It has also been found that the applied electrical bias acts to make the etch rate more uniform across the wafer surface, thereby minimizing the difference in etch patterns between the circumference and the center of the wafer.

DESCRIPTION OF THE DRAWINGS

The only FIGURE is a cross-sectional view of a RF plasma discharge apparatus that has been modified in accordance with the practice of this invention.

DESCRIPTION OF THE INVENTION

Referring to the FIGURE, there is illustrated a preferred apparatus 10 for creating a RF discharge plasma and adapted for etching a semiconductor wafer 12. The apparatus comprises an airtight housing 14 wherein the plasma is generated. Upper and lower electrodes 16 and 18 are positioned in horizontal, spaced relationship within housing 14. Planar horizontal electrode surfaces 20 and 22 are separated by a distance of 2 inches. Upper electrode 16 is electrically connected to a RF power supply 24 located exterior housing 14. Upper electrode 16 is prevented from direct electrical contact with grounded lower electrode 18 and grounded housing 14 by airtight, insulating seal 26. Housing 14 contains a low pressure atmosphere consisting of carbon tetrafluoride gas. When a suitable RF signal is applied to electrode 16, a discharge plasma is generated in the space between electrode surfaces 20 and 22.

In a preferred embodiment of this invention, a support 28 is positioned on lower electrode surface 22. The support comprises an alumina insulating body 30 having an aluminum conductive coating on the surface remote from the electrode surface 22. Support coating 32 is electrically connected to a variable DC power source 34 located exterior housing 14. The other pole of DC power source 34 is also electrically connected to lower electrode 18 and thus is grounded. Suitable insulating seals 36 protect the DC electrical connections where they pass through housing 14.

The semiconductor wafer 12 consists of a silicon base 38 and a thin surface film 40 consisting of a silicon-containing material which will be referred to in the Examples that follow. For purposes of illustration, it is desired to etch a window in film 40 to expose base 38. A conventional photoresist mask 42 is applied to film 40 to selectively expose the areas 44 to be etched while protecting the remaining film surface.

Generally circular wafer 12 is positioned upon circular support 28 such that silicon base 38 is adjacent metal coating 32 and the area 44 to be etched remote from support 28 and opposite upper electrode 16. In the following Examples, various wafers having diameters of 1 or 2 inches were tested on supports having diameters of about 2.5 inches. Thus, the wafer covered only a portion of the surface area of conductive coating 32. The remaining portion of coating 32 was left exposed to the plasma.

Insulating body 30 insulates wafer 12 from direct electrical contact with electrode 18 and conducting surface 32 connected to DC source 34 electrically biases wafer 12. The RF discharge in the $CF_4$ atmosphere near wafer 12 creates a plasma containing reactive species that etch area 44. As a result of the applied potential, a charge is built up on the exposed surfaces of mask 42 and area 44 and interacts with plasma constituents in the immediate region. This interaction effects the etch rate.

The following examples illustrate the use of the above apparatus wherein the silicon wafer is insulated from contact with the plasma discharge electrodes and biased with a time-constant potential to affect the etch rate.

EXAMPLE 1

The etch rate of silicon nitride was measured by preparing three silicon wafers having thin surface films (see 40 in the FIGURE) of plasma-deposited silicon nitride $Si_3N_4$. The wafers were approximately 12 mils thick and had a surface film of about 4000 A°. A portion of each surface was covered with conventional photoresist masks. Two wafers were then placed upon separate alumina supports having aluminum coatings. The third wafer was positioned upon a separate aluminum support. All supports were ⅛ inch high. The pressure of the $CF_4$ atmosphere was maintained at 0.11 torr. The plasma was continuously replenished by introducing fresh $CF_4$ gas and removing exhaust gas using conventional means not shown in the FIGURE. The discharge plasma was generated by applying an RF signal of 484 watts (356 rms volts × 1.36 rms amperes) at 45 kilohertz. The wafers were subjected to the discharge plasma for a predetermined time. Thereafter, an oxygen atmosphere was introduced to remove the masks without further etching the wafers. The etch rate was calculated by physically measuring the difference in height between the excposed and protected areas of the $Si_3N_4$ films and dividing by the time.

A −140 volts DC potential was applied to bias the wafer on one alumina support and the $Si_3N_4$ etch rate was 740 A°/min. The wafer on the other alumina support was biased with a +140 volts DC potential and the etch rate was 400 A°/min. No DC potential was applied to the aluminum support and the plasma etched the wafer surface at a rate of 600 A°/min. Thus, biasing the wafers with a DC potential has a substantial effect upon the etch rate. The effect of the biasing potential is limited to the plasma in the immediate vicinity of the wafer so that the etch rates of wafers positioned on independent supports can be selectively influenced. The flow of current was observed at the DC power supply and supports a theory that electron transferring interactions are involved. Microscopic examination of the wafers showed that the etch was substantially more uniform across the biased wafers than across the unbiased wafer.

EXAMPLE 2

The etch rate of silicon dioxide $SiO_2$ was measured in a substantially similar fashion to Example 1. Silicon wafers having thermal $SiO_2$ films were prepared and subjected to a plasma discharge of 510 watts (352 rms volts and 1.45 rms amperes) at 45 kilohertz in a 0.11 torr $CF_4$ atmosphere. A wafer biased with a −120 volts potential had a $SiO_2$ etch rate of 120 A°/min. A wafer biased with a +120 volts potential had an etch rate of 80 A°/min. The etch rate for an unbiased wafer on the aluminum support was 100 A°/min.

EXAMPLE 3

The etch rate of thermal silicon dioxide was again measured in the same manner as Example 2 except that the power of the plasma discharge was substantially increased to 1296 watts (417 rms volts and 3.11 rms amperes). A bias of −120 volts produced an etch rate of 120 A°/min. and a +120 volts bias produced an etch rate of 80 A°/min., the same as before. The unbiased wafer was positioned upon an alumina support instead of an aluminum support, but the etch rate was also 100 A°/min. Comparing the results obtained in this Example with Example 2 demonstrates a substantial effect that biasing has upon the etch rate of silicon dioxide in situations where increasing the plasma power has a minimal effect.

EXAMPLE 4

The etch rate of single crystal silicon Si was determined by processing wafers that had no thin film in a manner similar to Example 1. The plasma was adjusted to 496 watts (357 rms volts and 1.39 rms amperes) and 45 kilohertz. The plasma etched a wafer biased with a −120 volts DC potential at a rate of 500 A°/min. A wafer biased with a +120 volts DC potential etched at a rate of 100 A°/min. An unbiased wafer positioned on an aluminum support showed an etch rate of 160 A°/min. and an unbiased wafer positioned upon an alumina support showed an etch rate of 240 A°/min.

EXAMPLE 5

Example 4 was repeated except that the biasing potential was 60 volts instead of 120 volts. In a 485 watt plasma (358 rms volts and 1.35 rms amperes), the positively biased wafer was etched at a rate of 190 A°/min. and the negatively biased wafer was etched at a rate of 370 A°/min. The unbiased wafer on an alumina support was etched at a rate of 260 A°/min. Thus, to a certain extent the etch rate is affected by the size of the potential.

EXAMPLE 6

The etch rate of thermal silicon dioxide $SiO_2$ was again measured as in Example 2 except that the supports were composed of a fluorocarbon polymer having an aluminum conductive coating. The plasma was adjusted to 488 watts (356 rms volts and 1.37 rms amperes) and 45 kilohertz. The etch rate for a wafer biased with a −120 volts DC potential was 20 A°/min. The etch rate of a wafer biased with a +120 volts DC potential was 40 A°/min. The etch rate for the unbiased wafer was 80 A°/min. Thus, both a positive and negative bias decreased the etch rate. This example indicates the peculiar effect that the use of a biased fluorocarbon polymer support has upon the etch rate of a discharge plasma in an atmosphere containing carbon tetrafluoride.

The practice of this invention is not limited to the use of the particular equipment described in the preferred embodiment to produce the RF discharge plasma. Other equipment that utilizes an RF signal to generate a plasma can be modified to apply a DC potential in the vicinity of the surface to be etched. The DC potential is applied separate from the RF signal and so does not require altering the manner in which the plasma is generated. The effect upon the etch rate may be obtained utilizing potentials relatively small in comparison to the RF signal. Thus, the method of this invention enables the plasma etch rate to be selectively increased or decreased for a desired surface without significantly altering the overall discharge plasma. Although highly preferred, the electrical potential need not be applied directly to the surface being etched, but may suitably be applied to a separate electrical conductor in the immediate vicinity of said surface.

While in the preferred embodiment silicon and silicon compounds were etched, one skilled in the art would recognize that the subject method for controlling the etch rate is applicable to the etch of other materials. It is also apparent that subject method materials is not limited to a plasma produced in carbon tetrafluoride gas, but may be applied to control the etch rate of substantially any plasma containing a reactive etching species. The particular effect of the applied potential on the etch rate will obviously depend upon the nature of the material being etched and the reactive etching species found in the RF discharge plasma.

Although this invention has been described in terms of certain embodiments thereof, it is not intended that it be limited to the above description but rather only to the extent set forth in the claims that follow.

The embodiments of the invention in which an exclusive property or privilege is claimed are defined as follows:

1. In the method of plasma etching a surface of a workpiece wherein said surface is exposed to a RF plasma discharge containing reactive species, said plasma discharge being produced by applying to a low pressure gas a RF electrical signal using suitable electrical means, said plasma species reacting with said surface to convert portions thereof to a gaseous product to thereby etch said surface, the improvement comprising contacting the workpiece with an electrical conductor so as not to interfere with the contact of the exposed surface by the plasma, electrically insulating the conductor and the workpiece from the plasma-producing electrical means, and applying a time-constant electrical potential independent of the RF signal to said conductor to control the rate at which the surface is etched.

2. In the method of plasma etching a surface of a workpiece wherein said surface is exposed to a plasma discharge produced by applying a RF electrical signal using suitable electrical means to a low pressure gas to produce reactive etching species that react with said surface to form gaseous products, the improvement comprising insulating said surface from the plasma-producing electrical means and maintaining said workpiece at a time-constant electrical potential independent of said RF signal to control the rate at which the surface is etched.

3. In the method of plasma etching a surface of a workpiece comprising positioning said surface between electrodes arranged in spaced relationship, maintaining between said electrodes a low pressure gas, and applying to said electrodes a RF electrical signal to produce a plasma containing species that react with the surface to convert portions thereof to gaseous products to thereby etch said surface, the improvement comprising the steps of positioning the wafer on an insulating body that in turn is positioned upon one electrode, said body serving to insulate the wafer from the electrode while having a conductive member in electrical contact with the wafer, the wafer surface to be etched being exposed to the plasma, and applying a time-constant electrical potential to the conductive member independent of the RF signal to control the rate at which the surface is etched by the plasma.

4. In the method of plasma etching a surface of a silicon wafer comprising positioning said surface between spaced electrodes that are substantially larger than said wafer, maintaining between said electrodes a low pressure fluorocarbon gas, and applying to said electrodes a RF electrical signal to produce a plasma, said surface comprising a material selected from the group consisting of silicon and silicon compounds, said plasma containing species that react with the surface material to form gaseous products and thereby etch the surface, the improvement comprising the steps of positioning the wafer on an insulating body that in turn is positioned upon one electrode, said body serving to insulate the wafer from the electrode while having a conductive member in electrical contact with the wafer, the wafer surface to be etched being exposed to the plasma, and applying a time-constant electrical potential to the conductive member independent of the RF signal to electrically bias the wafer surface and thereby to control the rate at which the surface is etched by the plasma.

5. In the method of plasma etching a surface of a workpiece wherein said surface is exposed to a RF discharge plasma containing reactive etching species, said plasma being produced by subjecting a low pressure gas to a RF electrical signal, said plasma species chemically reacting with said surface to convert portions thereof to a gaseous product to thereby etch said surface, the improvement comprising applying a time-constant electrical potential independent of the RF signal directly to said workpiece to control the rate at which the surface is etched.

* * * * *